US007735649B2

(12) United States Patent
Kim-Gifford et al.

(10) Patent No.: US 7,735,649 B2
(45) Date of Patent: Jun. 15, 2010

(54) PACKAGING ASSEMBLY FOR CONTAINING AND DISPLAYING A PRODUCT

(75) Inventors: Hajung Kim-Gifford, Glen Allen, VA (US); Andrea C. Lantz, Glen Allen, VA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 861 days.

(21) Appl. No.: 11/429,610

(22) Filed: May 5, 2006

(65) Prior Publication Data

US 2007/0256952 A1 Nov. 8, 2007

(51) Int. Cl.
*B65D 73/00* (2006.01)

(52) U.S. Cl. ..... 206/485; 206/764; 206/499; 206/526; 206/765

(58) Field of Classification Search ..... 206/485, 206/784, 486, 764, 499, 526, 765
See application file for complete search history.

(56) References Cited

U.S. PATENT DOCUMENTS

| | | | | | |
|---|---|---|---|---|---|
| 2,426,899 | A | | 9/1947 | Pantalone | |
| 2,431,535 | A | | 11/1947 | Bergstrom | |
| 2,706,590 | A | * | 4/1955 | Bergstein | 206/433 |
| 2,856,067 | A | * | 10/1958 | Sparks | 206/366 |
| 3,157,275 | A | * | 11/1964 | Tolaas | 206/780 |
| 4,485,922 | A | | 12/1984 | Desmond et al. | |
| 4,832,199 | A | * | 5/1989 | Rigby | 206/485 |
| 5,494,166 | A | * | 2/1996 | Kuwata et al. | 206/528 |
| 5,505,309 | A | | 4/1996 | Taravella et al. | |
| 5,577,606 | A | * | 11/1996 | Schwentuchowski et al. | 206/327 |
| 5,979,662 | A | | 11/1999 | Green | |
| 6,050,420 | A | | 4/2000 | Green | |
| 6,152,305 | A | | 11/2000 | Green | |
| 6,279,757 | B1 | * | 8/2001 | Hayoun | 211/40 |
| 6,367,632 | B1 | | 4/2002 | Green | |
| 6,427,842 | B1 | | 8/2002 | Green | |
| 6,533,115 | B2 | * | 3/2003 | Saiki et al. | 206/327 |
| 6,568,588 | B2 | | 5/2003 | Holdsworth et al. | |
| 2001/0027934 | A1 | * | 10/2001 | Yoneda et al. | 206/725 |

* cited by examiner

*Primary Examiner*—Mickey Yu
*Assistant Examiner*—Jenine M Pagan

(57) ABSTRACT

A packaging assembly for containing and displaying a product includes a unitary material adapted for configuration into a tray. The tray includes a tray bottom, a first side wall formed integrally with the tray bottom, and a second side wall formed integrally with the tray bottom and opposed to the first side wall. The first side wall has a transverse cross sectional area of a first predetermined shape and the second side wall has a transverse cross sectional area of a second predetermined shape, the second predetermined shape being different from the first predetermined shape. The tray also includes a side notch defined in at least a portion of the first side wall cross sectional area and a bottom notch defined in at least a portion of the second side wall cross sectional area. The side notch has a height substantially equal to the height of the first side wall and the bottom notch has a height less than the side notch height.

20 Claims, 5 Drawing Sheets

PACKAGING ASSEMBLY FOR CONTAINING AND DISPLAYING A PRODUCT

BACKGROUND

The present disclosure relates generally to packaging assemblies, and more particularly to a packaging assembly for product containment and display.

Products packaged in clamshells are often stored and/or displayed in trays that hold the products in an upright position. Generally, such trays are a three-part assembly, having a main tray, an insert tray, and a cover. Such a three-part assembly may, in some instances, be cumbersome to assemble, require a relatively large amount of material, and require a large assembly area.

Due, at least in part, to their structure, these trays generally tend to weaken when on display over a longer period of time, whereby one or more tray sides may bow out. A tray having side slots adapted to support a product may be less capable of effectively supporting a product for display if one or more of the sides has/have bowed out.

Another potential drawback with such trays is that the relatively tall tray sides may impair the visibility of the product displayed in the tray. Sides that obscure the product may make it difficult for a consumer to find or recognize the item in the tray.

As such, it would be desirable to provide an improved system for containing and displaying a product, and an improved method for making the same.

SUMMARY

A packaging assembly for containing and displaying a product includes a unitary material adapted for configuration into a tray. The tray includes a tray bottom, a first side wall formed integrally with the tray bottom, and a second side wall formed integrally with the tray bottom and opposed to the first side wall. The first side wall has a transverse cross sectional area of a first predetermined shape, and the second side wall has a transverse cross sectional area of a second predetermined shape, the second predetermined shape being different from the first predetermined shape. The tray also includes a side notch defined in at least a portion of the first side wall cross sectional area, and a bottom notch defined in at least a portion of the second side wall cross sectional area. The side notch has a height substantially equal to the height of the first side wall and the bottom notch has a height less than the side notch height.

BRIEF DESCRIPTION OF THE DRAWINGS

Features and advantages of the present disclosure will become apparent by reference to the following detailed description and drawings, in which like reference numerals correspond to similar, though not necessarily identical components. For the sake of brevity, reference numerals or features having a previously described function may not necessarily be described in connection with other drawings in which they appear.

DETAILED DESCRIPTION

Embodiments of the method and system disclosed herein provide an improved packaging assembly for containing and displaying a product. The assembly is advantageously formed of a unitary material, thereby potentially reducing the amount of materials, the assembly time, and the cost associated with manufacturing the assembly.

It is to be understood that the terms "engage/engaged/engagement/engageable" and/or the like as used herein are broadly defined to encompass a variety of divergent connected arrangements and assembly techniques. These arrangements and techniques include, but are not limited to (1) the direct attachment between one component and another component with no intervening components therebetween; and (2) the attachment of one component and another component with one or more components therebetween, provided that the one component being "engaged with" the other component is somehow in operative engagement with the other component (notwithstanding the presence of one or more additional components therebetween). Additionally, two components may be permanently, semi-permanently, or releasably engaged with one another.

Further, it is to be understood that the terms "top," "bottom," "upper," "lower," "side," "front," "back," and/or like terms are not intended to be limited to, nor necessarily meant to convey a spatial orientation, but rather are used for illustrative purposes to differentiate views of the tray, etc. It is to be further understood that embodiment(s) of the present disclosure may be assembled/used in any suitable and/or desirable spatial orientation.

Figure 1:
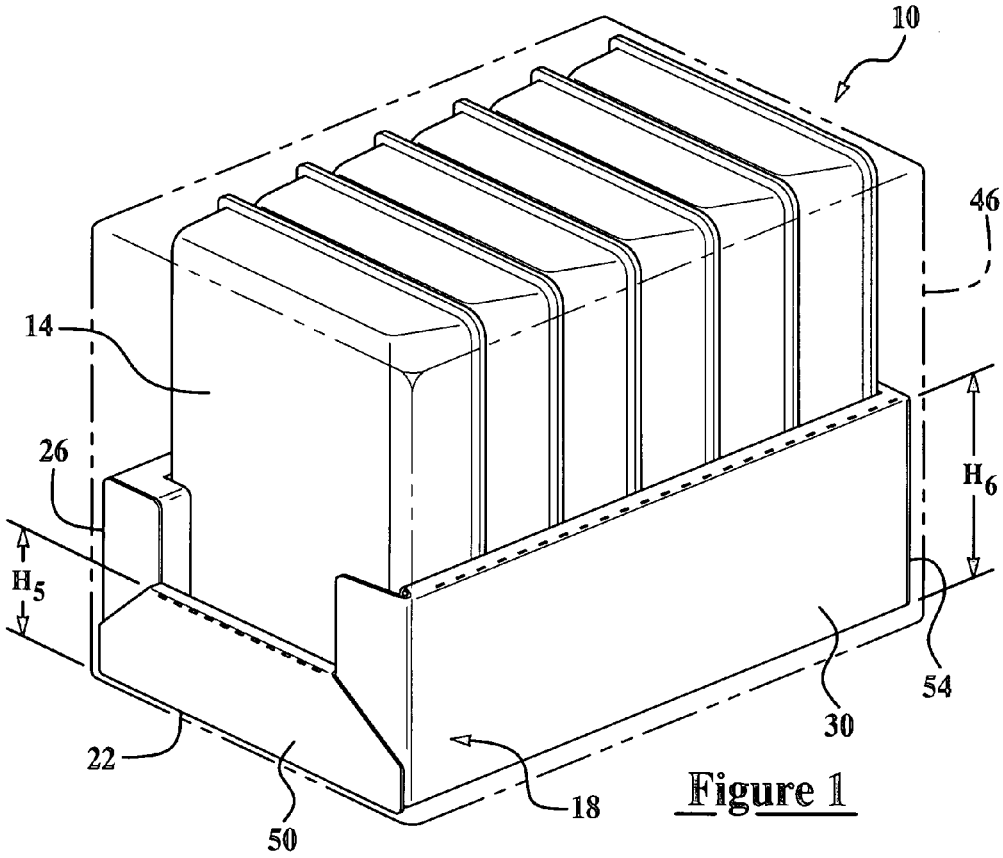
FIG. 1 is a perspective view of an embodiment of a packaging assembly containing and displaying a plurality of products.
Figure 2:
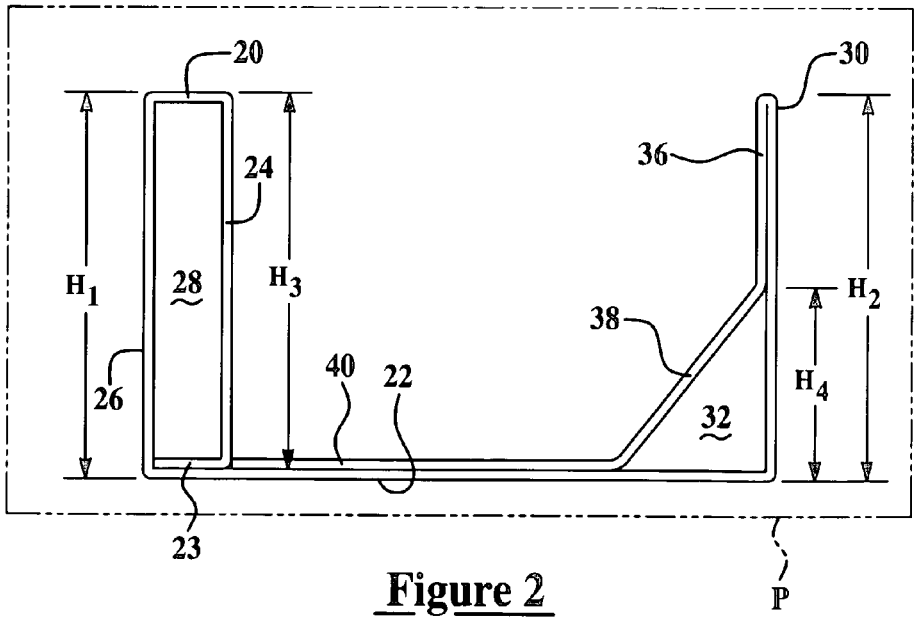
FIG. 2 is a front view of an embodiment (with the front and back walls removed for clarity) of a packaging assembly having a first side wall with a substantially rectangular transverse cross sectional area and a second side wall with a substantially triangular transverse cross sectional area.
Figure 3:
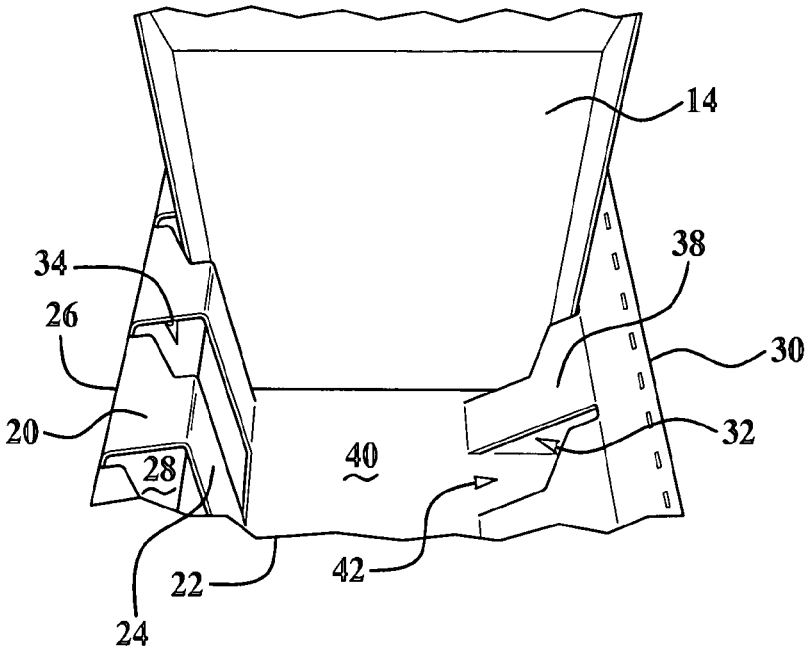
FIG. 3 is a top perspective cutaway view of an embodiment of a packaging assembly containing and displaying a product in one of the side notches and one of the bottom notches.

Referring now to FIGS. 1-3 together, different views of a packaging assembly 10 for containing and displaying product(s) 14 are depicted. The packaging assembly 10 generally includes a unitary material (58 shown in FIG. 4A) adapted for configuration into a tray 18. In an embodiment, the tray 18 includes a tray bottom 22, a first side wall 26 formed integrally with the tray bottom 22, and a second side wall 30 formed integrally with the tray bottom 22 and opposed to the first side wall 26.

As shown in FIG. 2, the second side wall 30 has a height $H_2$ that is substantially equal to a height $H_1$ of the first side wall 26. It is to be understood, however, that the walls 26, 30, individually, may each be of any suitable height, depending, at least in part, on the size of the product 14 to be stored/displayed. As a non-limitative example, the first side wall 26 and/or the second side wall 30 may be equal to or less than approximately 12.6 cm (about 5 inches) high. In another non-limitative example, the first side wall 26 and/or the second side wall 30 may be equal to or greater than approximately 5.08 cm (about 2 inches) high.

Generally, the first side wall 26 has a transverse cross sectional area 28 (shown in FIGS. 2 and 3) of a first predetermined shape, and the second side wall 30 has a transverse cross sectional area 32 (shown in FIGS. 2 and 3) of a second predetermined shape. In an embodiment, the second predetermined shape is different from the first predetermined shape. It is to be understood that the first and second predetermined shapes may be any suitable shape, as long as the two shapes are different from each other. As defined herein, "different" is to be interpreted as also including substantially similar shapes having aspect ratios (length to width) different from each other. As non-limitative examples, the first predetermined shape may be substantially rectangular, and the second predetermined shape may be substantially triangular (shown in FIG. 2). As further non-limitative examples, the first predetermined shape may be substantially rectangular, and the second predetermined shape may also be substantially rectangular, yet having a different aspect ratio from the first predetermined shape. In yet further non-limitative examples, the first predetermined shape may be substantially rectangular, and the second predetermined shape may be substantially square. It is to be further understood that the heights $H_3$, $H_4$ (shown in FIG. 2) of the first and second predetermined shapes may be different from each other, even if the heights $H_1$, $H_2$ of the first and second walls 26, 30 are substantially equal. As such, the first predetermined shape and/or the second predetermined shape may extend along and/or over the entire first side wall 26 or second side wall 30, respectively, or along and/or over any portion thereof.

In an embodiment, the transverse cross sectional area 28 of the first predetermined shape is defined by three or more walls 20, 23, 24, 26, one of which is the first side wall 26. In another embodiment, the transverse cross sectional area 32 of the second predetermined shape is defined by the tray bottom 22 and two or more walls 30, 38, one of which is the second side wall 30. It is to be understood that each of the side wall cross sectional areas 28, 32 includes the entire thickness of the walls (e.g., 20, 23, 24, 26 or 30, 38) which define the respective areas 28, 32, including any hollow portion therebetween.

As shown in FIG. 3, the packaging assembly 10 also includes at least one side notch 34 defined in at least a portion of the first side wall 26 cross sectional area 28. It is to be understood that the side notch 34 may have any suitable shape, which may be determined by, at least in part, the product 14 to be held/displayed in the assembly 10. Further, it is to be understood that, if there are a plurality of side notches 34, each of the side notches 34 may have a shape different from any other of the side notches 34; or one or more of the side notches 34 may have the same/similar shape. In an embodiment, the side notch 34 may be defined in substantially the entire first side wall 26 cross sectional area 28. Furthermore, the side notch 34 may have a height substantially equal to a height $H_1$ of the first side wall 26.

The packaging assembly 10 also includes at least one bottom notch 42 defined in at least a portion of the second side wall 30 cross sectional area 32. It is to be understood that the bottom notch 42 may have any suitable shape, which may be determined by, at least in part, the product 14 to be held/displayed in the assembly 10. Further, it is to be understood that, if there are a plurality of bottom notches 42, each of the bottom notches 42 may have a shape different from any other of the bottom notches 42; or one or more of the bottom notches 42 may have the same/similar shape. In an embodiment, the bottom notch 42 may be defined in substantially the entire second side wall 30 cross sectional area 32. Furthermore, the bottom notch 42 may have a height less than the side notch height.

It is to be understood that either, or both notches 34, 42 may extend through a portion of or substantially all of the respective cross sectional area 28, 32 without extending through the respective side walls 26, 30.

In an embodiment, the side notch 34 is substantially aligned with the bottom notch 42, such that the side notch 34 and bottom notch 42, together, are adapted to releasably engage at least a portion of the product 14. It is to be understood, however, that the product 14 may be supported by either the side notch 34 or the bottom notch 42, without assistance from the other of the bottom notch 42 or the side notch 34. As used herein, the phrase "substantially aligned" may refer to notches 34, 42 aligned substantially enough to allow for cooperative product 14 receipt and/or support. It is to be understood that a transverse plane P (as shown in FIG. 2) and an infinite number of transverse planes parallel to the transverse plane P, extend through the assembly 10. As a non-limitative example, a portion of a transverse plane parallel to the transverse plane P may simultaneously extend through at least a portion of each of the substantially aligned notches 34, 42.

The packaging assembly 10 may also have a plurality of side notches 34 and/or a plurality of bottom notches 42 defined in the first side wall 26 and second side wall 30, respectively. As mentioned above, it is to be understood that the packaging assembly 10 may include any number of side notches 34 and bottom notches 42. In an embodiment, the number of side notches 34 is equal to the number of bottom notches 42. As such, the packaging assembly 10 may be adapted to contain and display a plurality of products 14 therein. In another embodiment, as also mentioned above, two or more of the plurality of side notches 34 and/or two or more of the plurality of bottom notches 42 may have non-identical shapes. As such, the packaging assembly 10 may be adapted to contain and/or display a plurality of products 14 having two or more different shapes.

In an embodiment having a plurality of side and bottom notches 34, 42, it is to be understood that each of the plurality of side notches 34 may be associated and/or aligned with a respective, adjacent one of the plurality of bottom notches 42. As such, each associated side notch 34 and bottom notch 42 may form a pair, whereby each pair may be adapted to hold/support a product 14 therein.

The packaging assembly 10 may also include a unitary medium that is adapted for configuration into a cover 46, shown in phantom in FIG. 1. It is to be understood that the cover 46 is adapted to engage with the tray 18, and substantially enclose the product 14 therein. The cover 46 may be useful in a variety of applications, for example, to enclose the product(s) 14 during shipping and/or storing, so that the product(s) 14 are not exposed. In an alternate embodiment, the cover 46 may extend over a portion of the side walls 26, 30 without fully extending to the tray bottom 22.

The terms "material," "medium," and "sheet" are used interchangeably herein. It is to be understood that the unitary material, the unitary medium, and/or the unitary sheet may include any suitable material that is capable of being manipulated to form tray 18. As a non-limitative example, the unitary material/medium may be a corrugated cardboard material, a corrugated light metal material, a paperboard material, a plastic material, a sheet having a plurality of layers of different materials, or the like, or combinations thereof.

Embodiments of the packaging assembly 10 may also include a front wall 50 and/or a back wall 54 (shown in FIG. 1). The front wall 50 and/or the back wall 54 may have any suitable height, shape, and/or configuration. In an embodiment, the front wall 50 has a height $H_5$ that is equal to or less than approximately 7.6 cm (3 inches) high. In the embodiment shown in FIG. 1, the front wall 50 has a height $H_5$ less than that of the height $H_6$ of the back wall 54. In yet another embodiment, the back wall 54 may have a height $H_6$ substantially equal to or less than the front wall 50 height $H_5$. In still another embodiment, the front wall 50 and/or the back wall 54 may have a height $H_5$, $H_6$ equal to or greater than approximately 2.54 cm (about 1 inch).

The first side wall 26, the second side wall 30, the front wall 50, and/or the back wall 54 may be shorter or taller than the product 14 adapted for storage/display therein. In an embodiment, the first side wall 26, the second side wall 30, the front wall 50, and/or the back wall 54 may be adapted to enable visibility of one or more product(s) 14 located therein. As such, any combination of the walls 26, 30, 50, 54 may be relatively short with respect to the height of the product 14 located therein. As a non-limitative example, the heights $H_1$, $H_2$ of the side walls 26, 30 may be equal to or less than approximately 50% of the height of the product 14. In another non-limitative example, the heights $H_5$, $H_6$ of the front wall 50 and/or the back wall 54 may be equal to or less than approximately 25% of the product 14.

Referring now to FIGS. 4A-4D and 5A-5D, embodiments of a method for manufacturing a packaging assembly 10 are depicted. It is to be understood that the reference numerals used in these figures correspond to both the elements of the unitary sheet and to the elements of the formed tray 18. As an element of the unitary sheet may ultimately form an element of the tray 18, a single element may have two reference numerals associated therewith.

Figure 4A:
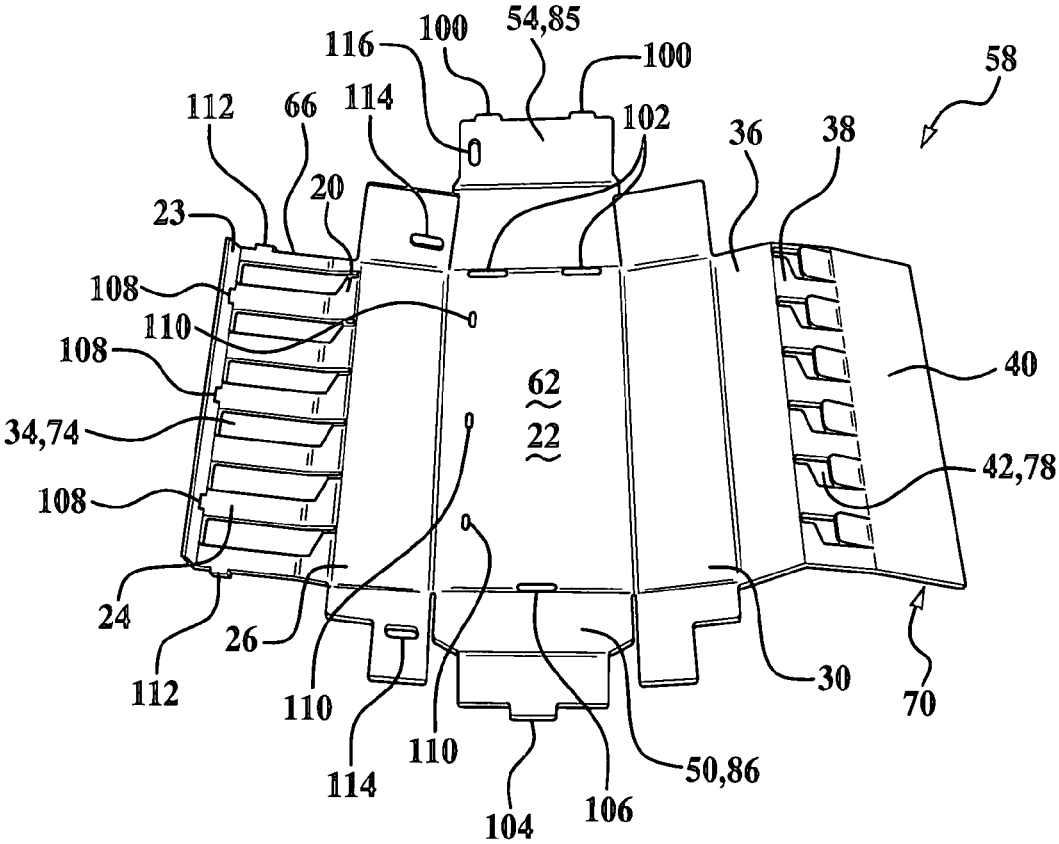
FIG. 4A is a top isometric view of an embodiment of a unitary material adapted for configuration into a tray.

Referring now to FIG. 4A, an embodiment of the method generally includes providing a unitary corrugated sheet 58 having a substantially rectangular bottom portion 62, a substantially rectangular first side portion 66 formed integrally with the bottom portion 62, and a substantially rectangular second side portion 70 formed integrally with the bottom portion 62. It is to be understood that the second side portion 70 is opposed to the first side portion 66. In an embodiment, the bottom portion 62 may include apertures 102, 106, 110.

The first side portion 66 may have a plurality of first apertures 74 defined therein, where each of the first apertures 74 has a predetermined shape. The first side portion 66 may also include apertures 114 and/or projections 108 and 112. The first side portion 66 also includes sections 20, 23, 24, 26 that, when folded, form the walls (as shown in FIG. 2) that define the first side wall cross sectional area 28.

The second side portion 70 may have a plurality of second apertures 78 defined therein, where each of the second apertures 78 has a second predetermined shape that is different from the predetermined shape of the first apertures 74. The second side portion 70 also includes sections 30, 36, 38, 40 that, when folded, form some of the walls (30, 38 as shown in FIG. 2) that define the second side wall cross sectional area 32. Sections 36 and 40 fold to align with other portions of the unitary sheet 58. For example, and as shown in FIG. 2, section 36 folds to align with a portion of the second side wall 30, and section 40 folds to align with a portion of the tray bottom 22.

The corrugated sheet 58 may also include a back portion 82 formed integrally with the bottom portion 62, and a front portion 86 formed integrally with the bottom portion 62 and opposed to the back portion 82. The back portion 82 may include projections 100 and aperture 116, and the front portion 86 may include projection 104.

Generally, one of the apertures 102, 106, 110, 114, 116 is capable of releasably engaging one of the projections 100, 104, 108, 112. As such, it is contemplated that any suitable number of the projections 100, 104, 108, 112 and apertures 102, 106, 110, 114, 116 having any suitable shape may be used, where desirable.

Figure 4B:
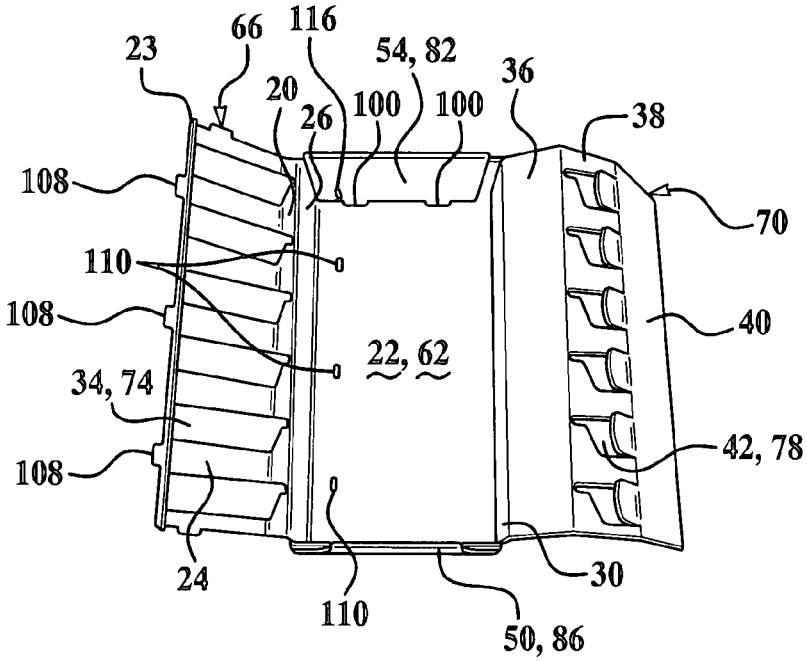
FIG. 4B is a top isometric view of the unitary material of FIG. 4A partially configured into a tray.

As illustrated in FIG. 4B, the method for manufacturing the packaging assembly 10 may also include folding the back portion 82 to form the back wall 54 extending substantially normal to the bottom portion 62, and folding the front portion 86 to form the front wall 50 extending substantially normal to the bottom portion 62. After folding the back portion 82 to form the back wall 54, projections 100 may engage with apertures 102, and aperture 114 may substantially align with aperture 116. Similarly, projection 104 may engage with aperture 106 after folding the front portion 86 to form the front wall 50, and one of the apertures 114 may remain exposed from the inside of the tray. It is contemplated that a package assembly 10 may be manufactured without a front wall 50 and/or a back wall 54. As such, the corrugated sheet 58 may be provided without a front portion 86 and/or a back portion 82 whereby the step of folding the front wall 50 and/or back wall 54 may be obviated.

Figure 4C:
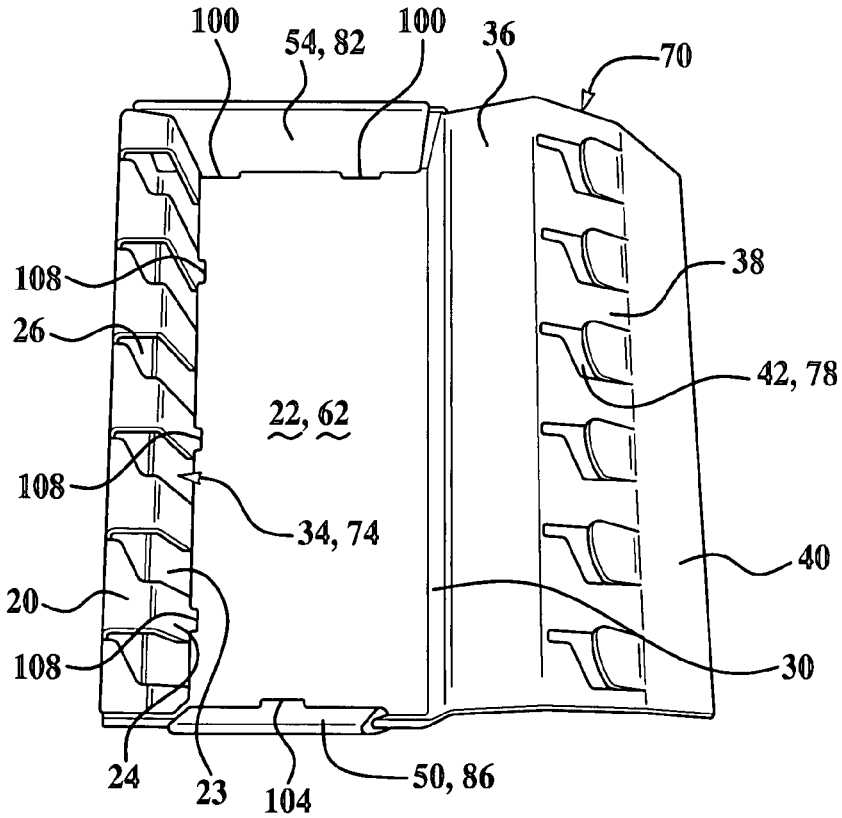
FIG. 4C is a top isometric view of the unitary material of FIG. 4B further partially configured into a tray.

Referring now to FIG. 4C, the method for manufacturing the packaging assembly 10 further includes folding the first side portion 66 to form the first side wall 26 extending substantially normal to the bottom portion 62. After folding the first side portion 66 to form the first side wall 26, projections 112 may engage with apertures 114, 116, and projections 108 may engage with apertures 110. The first side wall 26 has the transverse cross sectional area 28 of a first predetermined shape (not labeled for clarity, but shown in FIGS. 2, 3, and 4D). The first side wall 26 has a plurality of side notches 34 defined in at least a portion of the first side wall 26 cross sectional area 28 (as previously described). As depicted, the plurality of side notches 34 may be defined by the plurality of first apertures 74, and each of the plurality of side notches 34 may have a height substantially equal to a height $H_1$ of the first side wall 26.

Figure 4D:
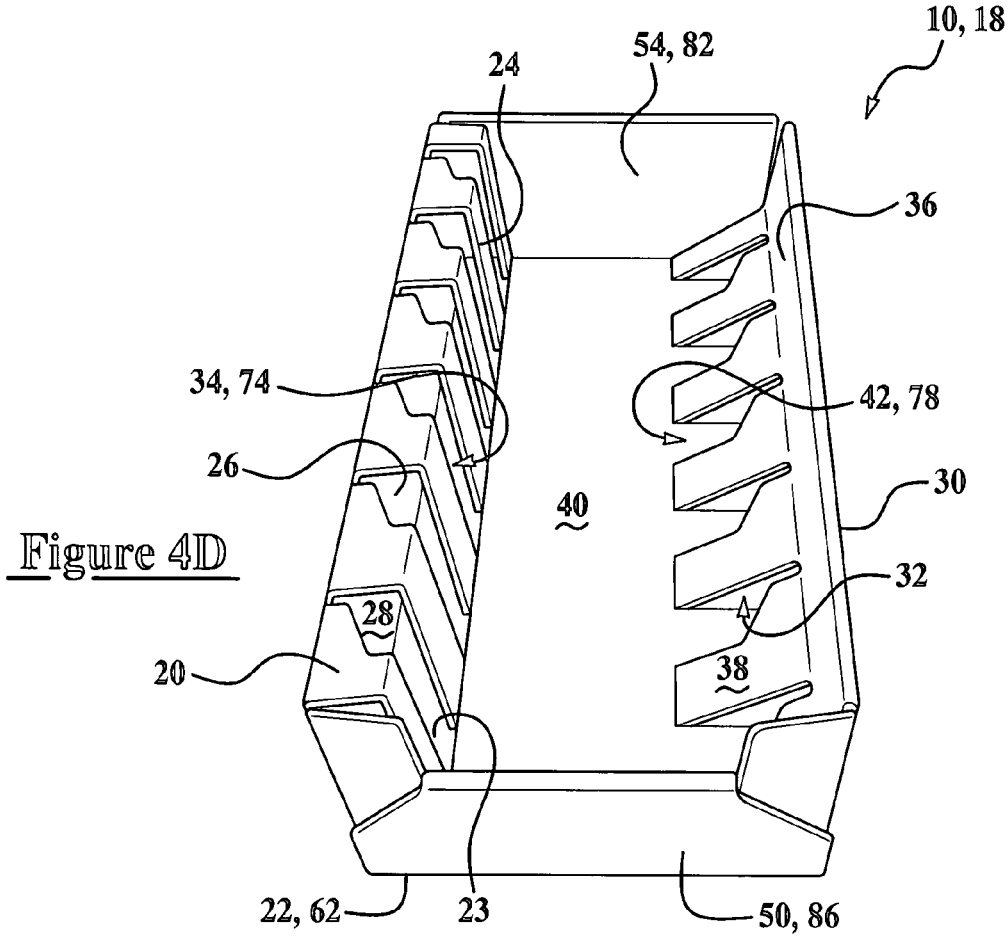
FIG. 4D is a top perspective view of the unitary material of FIG. 4C configured into a tray.

Referring now to FIG. 4D, the method further includes folding the second side portion 70 to form the second side wall 30 extending substantially normal to the bottom portion 62. The second side wall 30 has the transverse cross sectional area 32 of a second predetermined shape, which may be different than the shape of the first predetermined shape. The non-limitative example shown in FIG. 4D has a substantially rectangular first predetermined shape (i.e., cross sectional area 28), and a substantially triangular second predetermined shape (i.e., cross sectional area 32). Folding the second side portion 70 results in a plurality of bottom notches 42 defined in at least a portion of the second side wall cross sectional area 32. The bottom notches 42 may be defined by the plurality of second apertures 78 and may have a height less than the height of the side notches 34.

It is to be understood that embodiments of the method of manufacturing a packaging assembly 10 may include forming the walls 26, 30, 50, 54 by folding in any suitable or desirable order.

Figure 5A:
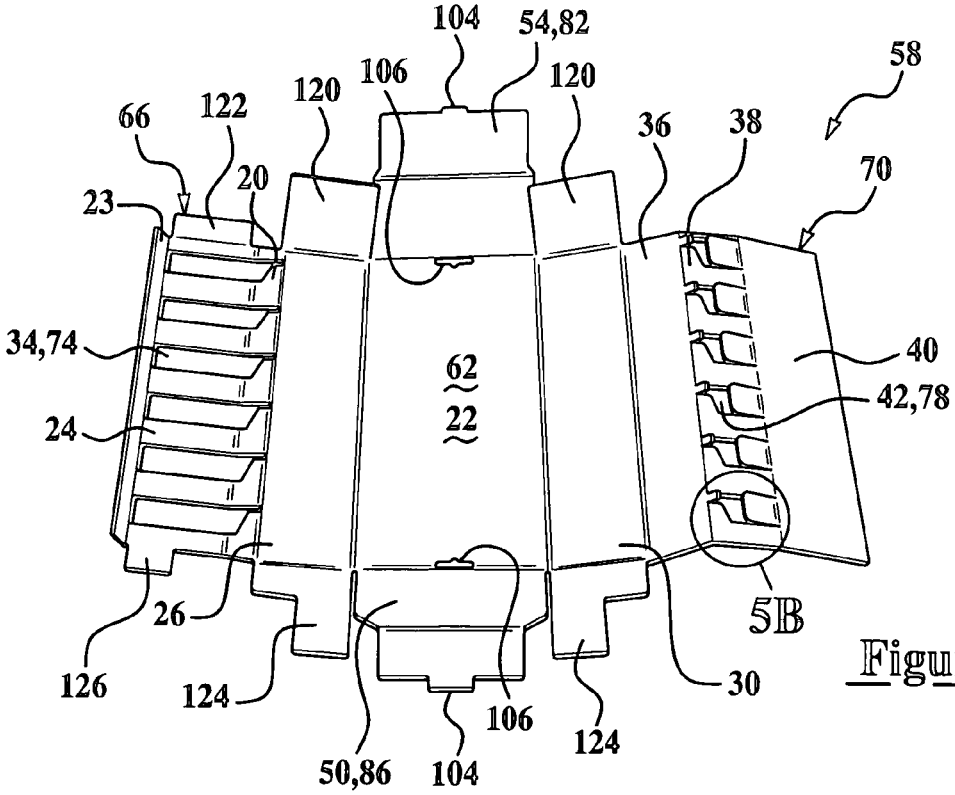
FIG. 5A is a top isometric view of another embodiment of a unitary material adapted for configuration into a tray.
Figure 5B:
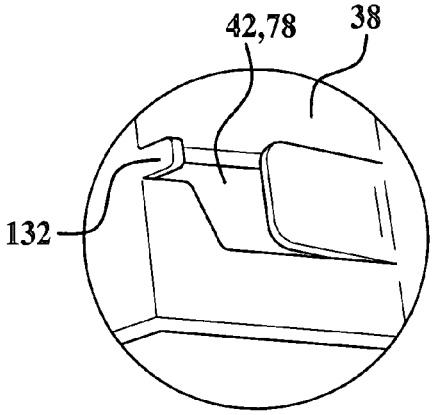
FIG. 5B is a top isometric view of a second aperture of the unitary material of FIG. 5A, enlarged to show detail.

Referring now to FIG. 5A, another embodiment of the method generally includes providing a unitary corrugated sheet 58 having a substantially rectangular bottom portion 62, a substantially rectangular first side portion 66 formed integrally with the bottom portion 62, and a substantially rectangular second side portion 70 formed integrally with the bottom portion 62. It is to be understood that the second side portion 70 is opposed to the first side portion 66. In an embodiment, the bottom portion 62 may include apertures 106, which may be of any suitable shape.

The first side portion 66 may have a plurality of first apertures 74 defined therein, where each of the first apertures 74 has a predetermined shape. The first side portion 66 may also include tabs 122, 126. The second side portion 70 may have a plurality of second apertures 78 defined therein, where each of the second apertures 78 has a second predetermined shape that is different from the predetermined shape of the first apertures 74. The second apertures 78 may also cooperatively engage with an associated tab 132, as shown in detail in FIG. 5B.

The corrugated sheet 58 may also include a back portion 82 formed integrally with the bottom portion 62, and a front portion 86 formed integrally with the bottom portion 62 and opposed to the back portion 82. The back portion 82 and front portion 86 may include projections 104, which may be of any suitable shape for releasable engagement with apertures 106.

Figure 5C:
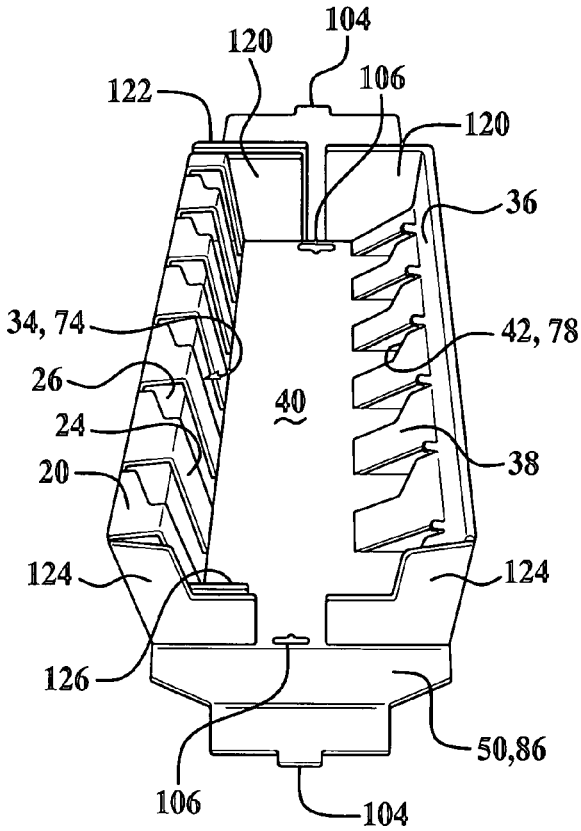
FIG. 5C is a top perspective view of the unitary material of FIG. 5A partially configured into a tray.

As illustrated in FIG. 5C, the embodiment of the method for manufacturing the packaging assembly 10 includes folding the first side portion 66 to form the first side wall 26 extending substantially normal to the bottom portion 62 and folding the second side portion 70 to form the second side wall 30 extending substantially normal to the bottom portion 62. The first side wall 26 has the transverse cross sectional area 28 of a first predetermined shape and the second side wall 30 has the transverse cross sectional area 32 of a second predetermined shape, which may be different than the shape of the first predetermined shape.

Figure 5D:
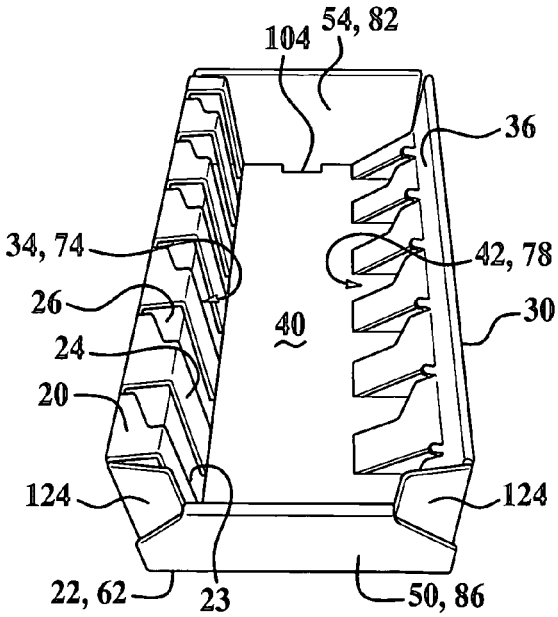
FIG. 5D is a top perspective view of the unitary material of FIG. 5A configured into a tray.

Referring now to FIG. 5D, the embodiment of the method may further include folding the back portion 82 to form the back wall 54 extending substantially normal to the bottom portion 62, and folding the front portion 86 to form the front wall 50 extending substantially normal to the bottom portion 62. After folding the back portion 82 to form the back wall 54, tabs 120, 122 may form an inner portion of the back wall 54 (e.g., tabs 120, 122 are substantially surrounded by back portion 82), and projection 104 may engage with aperture 106. Similarly, after folding the front portion 86 to form the front wall 50, tabs 124,126 may form an inner portion of the front wall 50 (e.g., tabs 124, 126 are substantially surrounded by front portion 86), and projection 104 may engage with aperture 106.

An embodiment of a method for manufacturing a packaging assembly 10 may also include forming a corrugated cover 46 (shown in FIG. 1) for engagement with the front wall 50, back wall 54, first side wall 26, and/or second side wall 30.

The packaging assembly 10 disclosed herein may releasably support one or a plurality of products 14. Generally, each of the products 14 is supported by and/or partially or fully contained within one of the side notches 34 and a respective, adjacent one of the bottom notches 42.

Embodiments of the assembly 10 include, but are not limited to the following advantages. The assembly 10 may be designed to contain and display a variety of products 14, including (as non-limitative examples): ink cartridges, media products, promotional products, or the like, or combinations thereof. Furthermore, the assembly 10 is advantageously formed of a unitary material, thereby potentially reducing the amount of materials used to form the assembly 10, the time required to form the assembly 10, and/or the costs associated with manufacturing the assembly 10.

While several embodiments have been described in detail, it will be apparent to those skilled in the art that the disclosed embodiments may be modified. Therefore, the foregoing description is to be considered exemplary rather than limiting.

What is claimed is:

1. A packaging assembly for containing and displaying a product, the packaging assembly comprising:

a unitary material adapted for configuration into a tray, the tray including:

a tray bottom;

a first side wall formed integrally with the tray bottom, the first side wall having a substantially rectangular transverse cross sectional area defined by peripheral edges of the first side wall;

a second side wall formed integrally with the tray bottom and opposed to the first side wall, the second side wall having a substantially triangular transverse cross sectional area defined by peripheral edges of the second side wall;

a side notch defined in at least a portion of the first side wall substantially rectangular transverse cross sectional area, the side notch having a height substantially equal to a height of the first side wall; and a bottom notch defined in at least a portion of the second side wall substantially triangular transverse cross sectional area, the bottom notch having a height less than the side notch height.

2. The packaging assembly of claim 1 wherein at least one of the first side wall or the second side wall is adapted to enable visibility of the product located therein.

3. The packaging assembly of claim 1, further comprising at least one of a front wall or a back wall.

4. The packaging assembly of claim 3 wherein at least one of the first side wall, the second side wall, the front wall, or the back wall is adapted to enable visibility of the product located therein.

5. The packaging assembly of claim 3 wherein the front wall is equal to or greater than approximately 2.54 cm (about 1 inch) high.

6. The packaging assembly of claim 1 wherein the side notch is defined in substantially the entire first side wall cross sectional area, and wherein the bottom notch is defined in substantially the entire second side wall cross sectional area.

7. The packaging assembly of claim 1 wherein the side notch is substantially aligned with the bottom notch, and wherein the side notch and bottom notch together are adapted to releasably engage at least a portion the product.

8. The packaging assembly of claim 1 wherein at least one of the first side wall or the second side wall is equal to or greater than approximately 5.08 cm (about 2 inches) high.

9. The packaging assembly of claim 1, further comprising a plurality of the side notches and a plurality of the bottom notches.

10. The packaging assembly of claim 9 wherein each of the plurality of side notches is associated with a respective, adjacent one of the plurality of bottom notches.

11. The packaging assembly of claim 1 wherein the second side wall has a height substantially equal to the height of the first side wall.

12. The packaging assembly of claim 1, further comprising a unitary medium adapted for configuration into a cover, the cover adapted to engage with the tray and substantially enclose the product therein.

13. The packaging assembly of claim 12 wherein at least one of the tray or the cover is formed from a material selected from corrugated materials, paperboard materials, plastic materials, sheets having a plurality of layers of different materials, and combinations thereof.

14. The packaging assembly of claim 1 wherein the packaging assembly is reusable.

15. The packaging assembly of claim 1 wherein the product is releasable other than by rendering the packaging assembly unfit for containing and displaying further products.

16. The packaging assembly of claim 1, further comprising:

at least one other side notch; and at least one other bottom notch corresponding to the at least one other side notch;

wherein i) the side notch and the at least one other side notch, ii) the bottom notch and the at least one other bottom notch, iii) or combinations thereof have non-identical shapes, whereby the packaging assembly is adapted to at least one of display or contain a plurality of products having two or more different shapes.

17. The packaging assembly of claim 1 wherein the transverse cross sectional area of the second side wall is defined by a plurality of folded sections, and wherein at least one of the plurality of folded sections includes an edge that abuts the first side wall and retains the first side wall in place.

18. A method for manufacturing a packaging assembly, the method comprising:

providing a corrugated sheet having:

a substantially rectangular bottom portion;

a substantially rectangular first side portion formed integrally with the bottom portion and having a plurality of first apertures defined therein, the first apertures having a first predetermined shape;

a substantially rectangular second side portion formed integrally with the bottom portion, the second side portion opposed to the first side portion and having a plurality of second apertures defined therein, the second apertures having a second predetermined shape different from the first predetermined shape;

a back portion formed integrally with the bottom portion; and a front portion formed integrally with the bottom portion, the front portion opposed to the back portion;

folding the back portion to form a back wall extending substantially normal to the bottom portion;

folding the front portion to form a front wall extending substantially normal to the bottom portion;

folding the first side portion to form a first side wall extending substantially normal to the bottom portion, the first side wall having a substantially rectangular transverse cross sectional area defined by peripheral edges of the first side wall, and the first side wall having a plurality of side notches defined in at least a portion of the first side wall cross sectional area, the plurality of side notches defined by the plurality of first apertures, each of the plurality of side notches having a height substantially equal to a height of the first side wall; and folding the second side portion to form a second side wall extending substantially normal to the bottom portion, the second side wall having a substantially triangular transverse cross sectional area defined by peripheral edges of the second side wall, and the second side wall having a plurality of bottom notches defined in at least a portion of the second side wall cross sectional area, the bottom notches defined by the plurality of second apertures, each of the plurality of bottom notches having a height less than the height of the side notches.

19. The method of claim 18 wherein the packaging assembly is adapted to releasably support a plurality of products, each of the plurality of products adapted to be supported within one of the plurality of side notches and a respective, adjacent one of the plurality of bottom notches.

20. The method of claim 18, further comprising forming a corrugated cover for engagement with at least one of the front wall, the back wall, the first side wall, or the second side wall.

* * * * *